United States Patent [19]

Sato

[11] 3,970,309

[45] July 20, 1976

[54] RACING GAME

[75] Inventor: Akihiro Sato, Tokyo, Japan

[73] Assignee: Tomy Kogyo Co., Inc., Tokyo, Japan

[22] Filed: Mar. 7, 1975

[21] Appl. No.: 556,403

[52] U.S. Cl. ..... 273/86 B; 46/1 K; 46/202; 46/261

[51] Int. Cl.[2] ..... A63F 9/14

[58] Field of Search ..... 273/86 R, 86 B; 46/1 K, 46/243 M, 243 LV, 243 P, 202; 104/160

[56] References Cited

UNITED STATES PATENTS

| | | | |
|---|---|---|---|
| 2,832,177 | 4/1958 | Mueller | 46/243 LV UX |
| 3,228,600 | 1/1966 | May | 273/86 R X |
| 3,313,242 | 4/1967 | Voce | 273/86 B UX |
| 3,377,958 | 4/1968 | Bax et al. | 273/86 B |
| 3,540,153 | 11/1970 | Aoki | 46/243 P |
| 3,630,524 | 12/1971 | Cooper et al. | 273/86 R |
| 3,674,269 | 7/1972 | Cooper et al. | 273/86 R |
| 3,712,615 | 1/1973 | Staats et al. | 273/86 R |
| 3,860,237 | 1/1975 | Cooper et al. | 273/86 R |

*Primary Examiner*—Anton O. Oechsle
*Attorney, Agent, or Firm*—Staas & Halsey

[57] ABSTRACT

There is disclosed herein a racing game consisting of a continuous trackway defining separate paths constructed such that the racing vehicles travel faster in one path than in the other, a switching section provided in the trackway normally diverting each vehicle from the faster path to the slower path and actuating members available to each of the players permitting the vehicles to be diverted from the slower path to the faster path, a recharging station wherein the miniature electric motors powering the vehicles are recharged as desired by the players and a counting station recording the number of times each of the player's vehicles has traversed the trackway.

12 Claims, 10 Drawing Figures

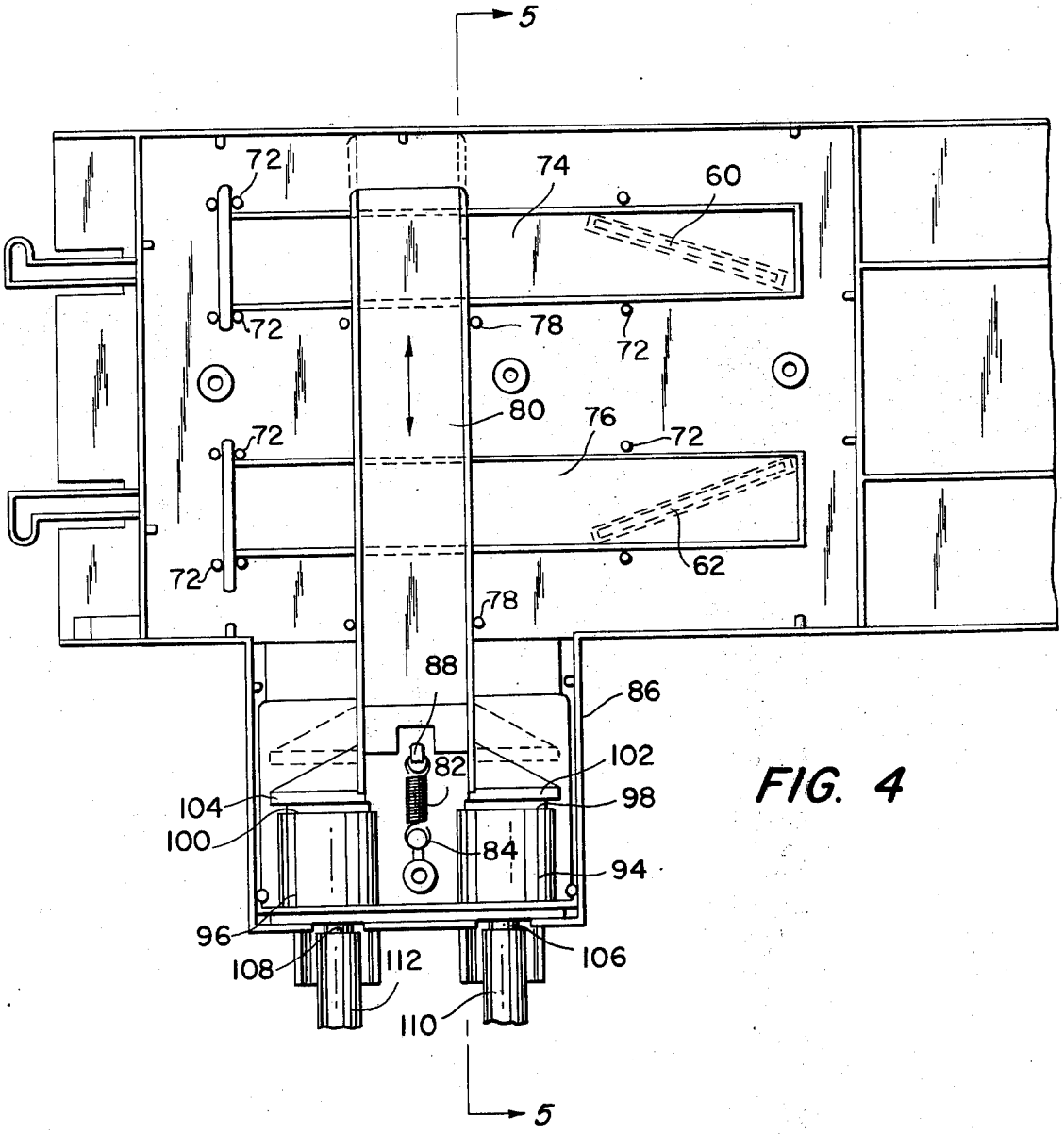
FIG. 4
FIG. 5
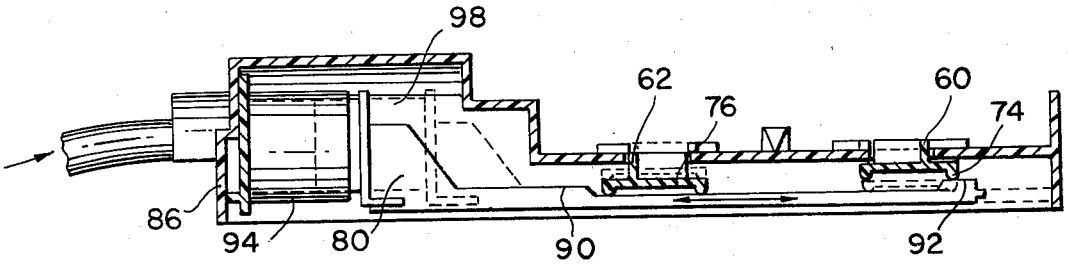

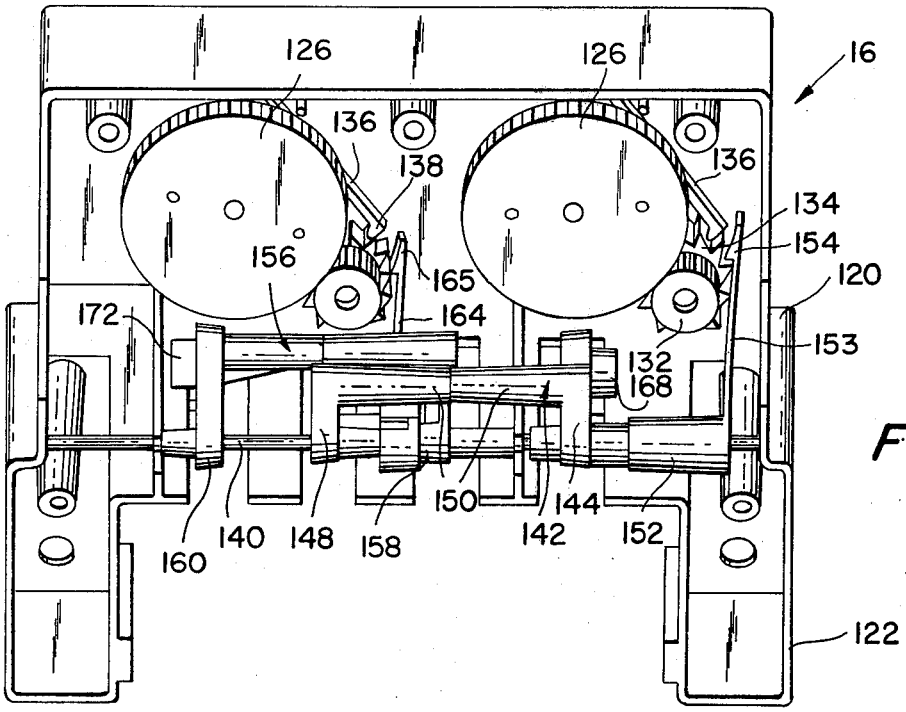
FIG. 6
FIG. 7
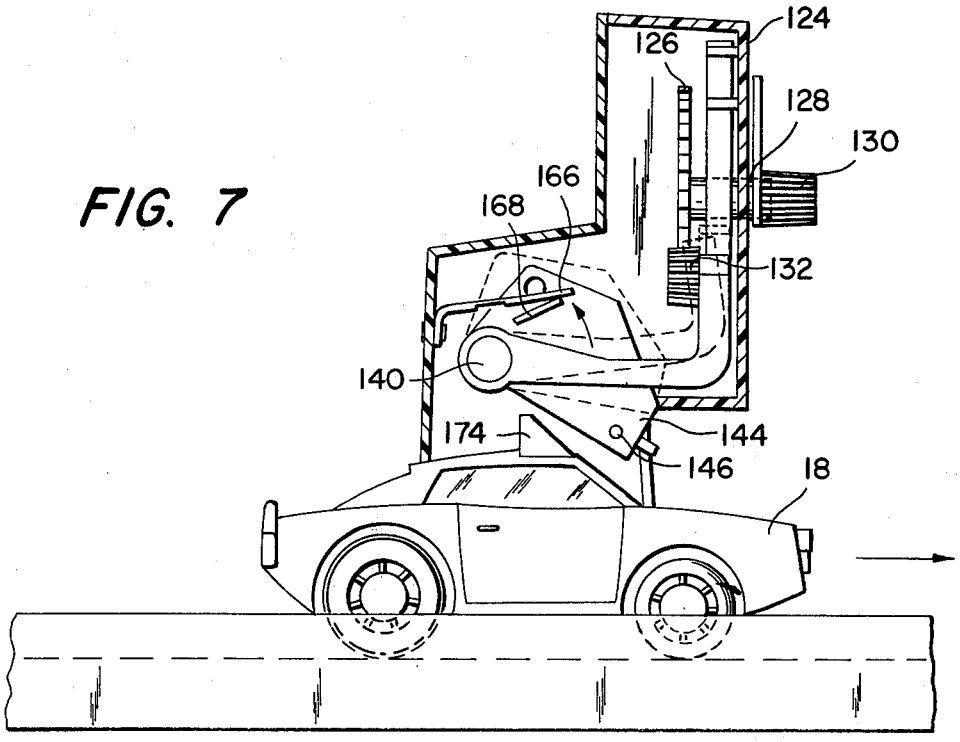

14
18
20
22
32
176
178
184
196
198
200
202
204
206
208
212
216
218
220
224
226
232
246
PIT-IN
CHARGE
PIT-OUT

RACING GAME

BACKGROUND AND SUMMARY OF THE INVENTION

The present invention falls within the general class of racetrack amusement devices wherein each player is assigned a racing vehicle and is capable of maneuvering to a limited extent the speed and path of travel of the vehicle. As distinguished from known prior art racetrack amusement devices, the present invention features a variety of functions including a switching section wherein each player attempts not only to permit his vehicle to travel in the faster of the two racing paths but additionally is permitted to attempt to prevent his opponent from operating his vehicle in the faster path. Furthermore, each player is permitted to divert his vehicle from the racetrack to a charging station and thereafter energize the miniature electric motor, after which the vehicle resumes the race. Finally, there is provided a counting station which independently counts and records the number of times each of the vehicles has successfully traversed the trackway, regardless of whether the vehicle is on the faster or slower path.

BRIEF DESCRIPTION OF THE DRAWINGS

FIG. 4 is a bottom plan view of a portion of the switching station with a panel removed so as to illustrate the mechanism for actuating the reciprocably mounted rail sections that are responsible for changing the path of travel of each vehicle;

FIG. 5 is a cross sectional view taken along line 5 — 5 of FIG. 4 illustrating the reciprocably mounted rail sections and the reciprocating ram mechanism provided with cam surfaces for sequentially actuating the rail sections for diverting the path of travel of each vehicle;

FIG. 6 is a perspective view of the counting and recording station with the front panel thereof removed so as to illustrate the operative mechanisms responsible for counting and recording the number of times each vehicle traverses the trackway, regardless of whether travelling along the outer, faster path or the inner, slower path;

FIG. 7 is a cross sectional view of the counting mechanism illustrating actuation of the counter as one of the toy vehicles passes through the station;

DESCRIPTION OF THE PREFERRED EMBODIMENT

Figure 1:
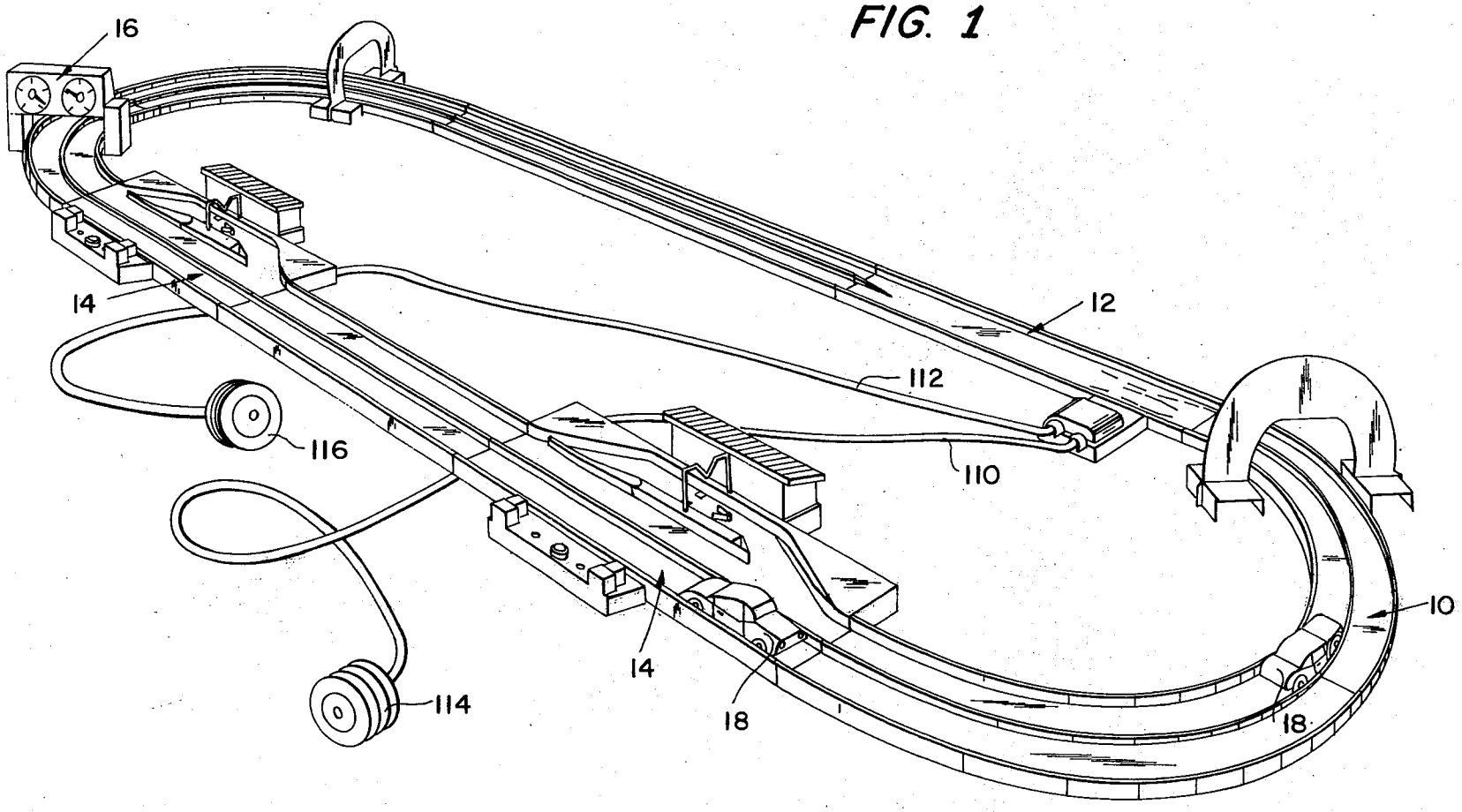
FIG. 1 is a perspective view of the racing game illustrating generally the continuous trackway, the switching station, the two energizing stations and the counting and recording station.

As illustrated in FIG. 1, the racing game consists of a trackway generally designated by the reference numeral 10, a switching section 12, two "pit-stop" recharging stations 14, a counting and recording station 16, and the racing vehicles 18.

Figure 2:
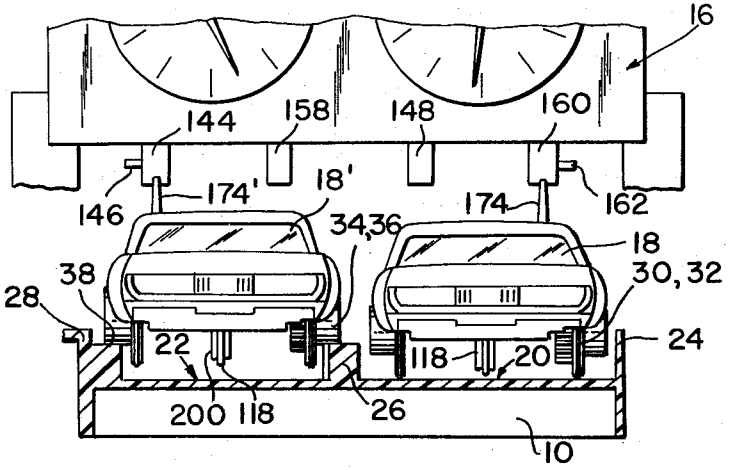
FIG. 2 is a typical cross sectional view of the trackway illustrating in particular the outer, faster path wherein the wheels of the vehicle directly engage the racing surface, and the inner, slower path wherein the hubs of the vehicles engage shoulders on each side of the racing surface reducing the speed of the vehicle and also the relationship between the depending members of the counting mechanism and the actuating members of each vehicle.

The trackway 10 consists of a plurality of sections that may be connected together to define the continuous path of travel of the vehicles. As illustrated in FIG. 2, the trackway is constructed to define a first outside path 20 and a second inside path 22. More particulaly, there are provided along the trackway 10 upstanding walls 24, 26 and 28 defining the paths 20 and 22. The path 20 is constructed to permit the vehicles 18 to move more rapidly than the path 22. When one of the vehicles 18 is within the faster path 20, it will be apparent that both the front and rear wheels 30 and 32, respectively, of the vehicle 18 rests directly against the racing surface of the first path 20 whereas when the vehicle is within the second path 22 the front and rear hubs 34 and 36, respectively, engage the upstanding wall 26 and the shoulder 38 of the wall 28. Thus, whereas the engagement of the front and rear wheels 30 and 32 of the vehicles 18 against the surface of the first path 20 is responsible for propelling the vehicles along the path 20, the engagement of the front and rear hubs 34 and 36 against the wall 26 and shoulder 38 is responsible for propelling the vehicles along the path 22. As the hubs 34 and 36 are smaller in diameter than the wheels 30 and 32 it is readily apparent that the engagement of the hubs 34 and 36 against the wall 26 and shoulder 38 promotes slower movement of the vehicles 18 along the second path 22 than where the wheels 30 and 32, of larger diameter than the hubs 34 and 36, directly engage the racing surface of the first path 20. The foregoing is significant since as will be explained in detail hereinafter the purpose of the switching section 20 is to permit the respective players to attempt to keep their respective vehicles 18 in the faster path 20.

Figure 3:
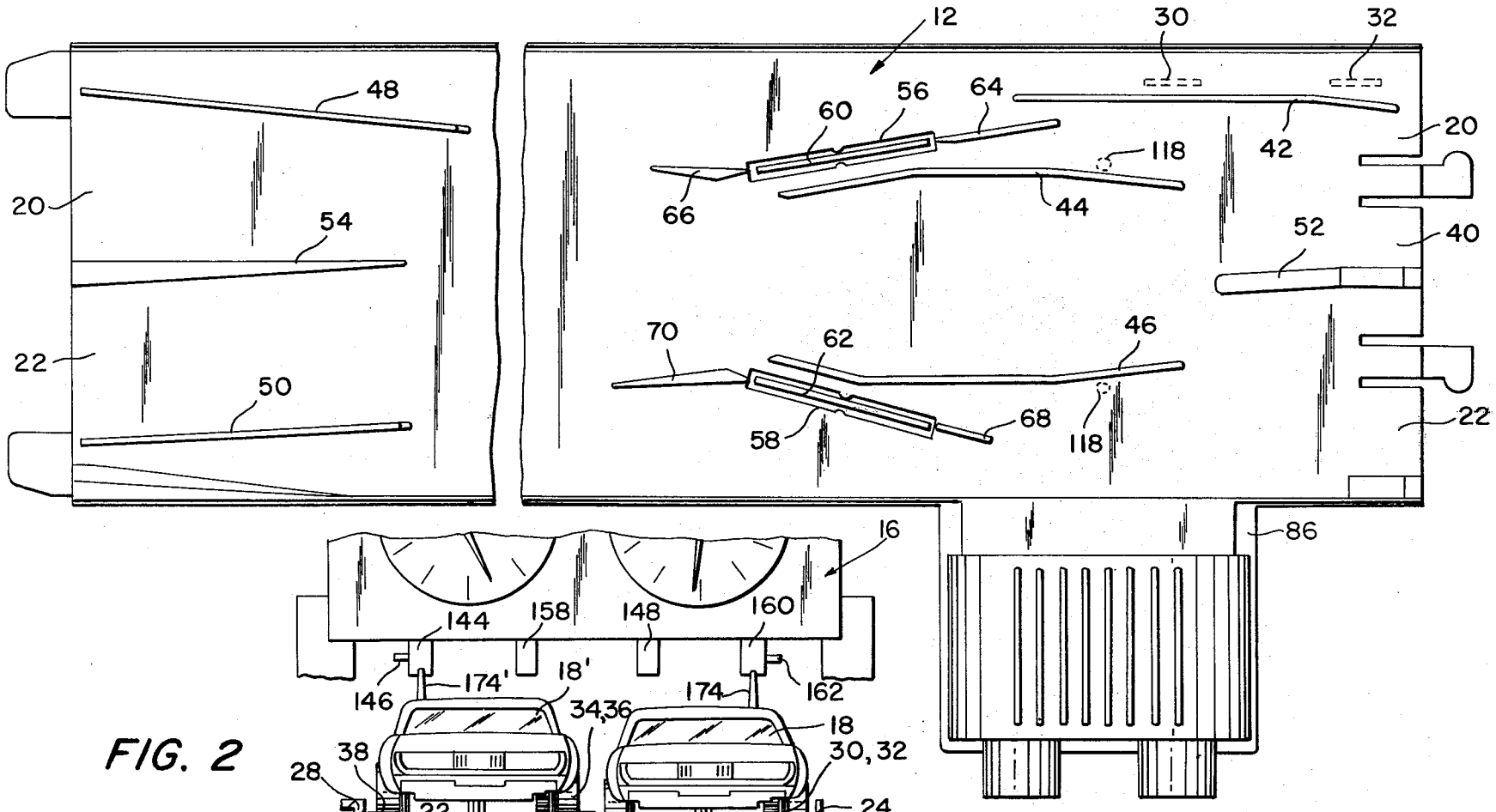
FIG. 3 is a top plan view of the switching section illustrating the configuration of the stationary rails and the reciprocably mounted rail sections that when operated divert the normal path of each vehicle.

The switching section 12 is illustrated in FIGS. 3 – 5 and comprises a base 40 provided with upstanding rails designated by the reference numerals 42, 44, 46, 48 and 50, and continuation rails of the center, upstanding wall 26 designated by the reference numerals 52 and 54. Slots 56 and 58 are provided within the base 40 through which reciprocably mounted rails 60 and 62 may protrude, there being further provided an entrance rail 64 and an exit rail 66 at the ends of the slot 56 and in like manner an entrance rail 68 and an exit rail 70 at the ends of the slot 58.

Turning now to FIG. 4, a series of protrusions 72 are oriented to align members 74 and 76 for reciprocating movement, it being apparent that the upstanding rails 60 and 62 are formed as an integral part of the members 74 and 76. Protrusions 78 in similar manner align the ram 80 for reciprocating movement. A spring 82 is connected at one end to a post 84 formed as an integral part of the housing 86 and at the other end thereof to the flange 88 formed as an integral part of the ram 80. In this manner, the force of the spring 82 normally biases the ram 80 to the position illustrated in solid lines in FIG. 4. As can be seen in FIG. 5, the ram 80 is further provided with cam surfaces 90 and 92. As will now be apparent, when the ram 80 is located in its retracted position under the influence of the spring 82 the cam surface 92 is positioned directly beneath one of the legs of the member 74 urging same upwardly such that the upstanding rail 62 is moved upwardly so as to protrude through the opening 58 into operative position. It will also be apparent that as the ram 80 is moved forwardly against the force of the spring 82 to the position designated by dotted lines in FIG. 4 the cam surface 92 disengages from the member 74 whereas the cam surface 90 engages the legs of the member 76 forcing same upwardly at which time the upstanding rail 60 forming a part thereof protrudes upwardly through the opening 56 to operative position.

It will be further apparent from FIG. 4, that the housing 86 is provided with cylinders 94 and 96 within which are located reciprocably mounted hollow pistons 98 and 100. The pistons 98 and 100 terminate in solid faces which normally abut the flanges 102 and 104 of the ram 80. Leading into the hollow cavities defined by the cylinders 94 and 96 and the pistons 98 and 100 are hollow conduits 106 and 108 to which the hoses 110 and 112 are secured. It is apparent from FIG. 1 that operatively mounted to the ends of the hoses 110 and 112 are flexible bellows 114 and 116 of conventional construction. Thus, as either or both of the players depresses his respective bellows 114 and 116 air is compressed within the corresponding lines 110 and 112 so as to force the corresponding pistons 98 and 100 outwardly in turn urging the flanges 102 and 104 of the ram 80 forwardly against the force of the spring 82. It should be noted that while each player has his separate bellows 114, 116 the actuation of either of the bellows results in the ram 80 being pushed forwardly so as to raise the rail section 62 and lower the rail section 60.

Turning now to FIG. 3, it will be apparent that when one of the vehicles 18 enters the switching section 12 from the outside, faster path 20, the outside front and rear wheels 30 and 32 are located outside of the rail 42 whereas the guiding rod 118 depending from the vehicle 18 is positioned on the right side of the rail 44. Since the upstanding rail 60 is normally in raised position protruding upwardly through the slot 56 it will be readily apparent that the rod 118 depending from the vehicle 18 is confined between the rails 44 and 60 thus causing the vehicle to turn to the left in conformity with the configuration of the rails 44 and 60 and thereby be directed towards the inside, slower path 22 which, as illustrated in FIG. 3, is located on the left-hand side of the extension 54 of the rail 26. Should, however, the rail 60 be in its lowered, inoperative position below the slot 56 it is apparent that the guiding rod 118 depending from the vehicle 18 is not so confined and will thereby continue its forward, straight movement along the first path 20 until the outside front wheel 30 of the vehicle engages the rail 48 at which time the vehicle 18 is straightened, if necessary, to continue its movement along the outside, fast path 20.

It will also be apparent that when one of the vehicle 18 enters the switching station 12 from the inside, slower path 22 the reciprocably mounted rail 62 is normally in its lowered, inoperative position in which case the guiding rod 118 depending from the vehicle 18 is located, as illustraded in FIG. 3, on the left-hand side of the permanent rail 46 and is not obstructed by the lowered inoperative rail 62 thus permitting the vehicle 18 to continue its forward movement along the inner, slower path 22. Eventually, the left front wheel 30 engages the rail 50 causing the vehicle 18 to be aligned within the path 22, if necessary, and in particular to permit the hubs 34 and 36 of the vehicle to properly engage with the shoulder 38 of the wall 28 and the wall 26. It is further apparent that when either of the bellows 114 and 116 are depressed in such manner as to actuate the pistons 98 and 100 so as to move the ram 80 forward, the rail 62 is moved upwardly to its operative position at which time it will be apparent from FIG. 3 that the guiding rod 118 of the vehicle 18 is confined between the stationary rail 46 and the raised rail 62 causing the vehicle to turn to the right to be diverted to the outside, faster path 20, the rail section 48 once again serving to stabilize the entry of the vehicle 18 to the outer, faster path 20.

With the foregoing in mind, certain of the objectives and tactics of the present racing game will now be explained. The object of the racing game device of the present invention is for each player to attempt to maneuver his vehicle into the outside, faster path 20. Since the rail 60 is normally positioned in its raised, operative position a vehicle entering the switching section 12 from the outside, faster path 20 will normally be diverted to the slower, inside path 22. Since the rail 62 is normally in its lowered, inoperative position a vehicle entering the switching section 12 from the inside, slower path 20 will normally not be diverted and will continue moving along the inside, slower path 22. Thus, the rails 60 and 62 are designed to promote movement along the slower, inside path 22. It is, therefore, necessary for each player to attempt to maneuver the rails 60 and 62 by operating the bellows 114 and 116 to change the normal setting of the rails 60 and 62 to promote travel of the respective vehicles along the outside, faster path 20. Thus, where a vehicle is travelling along the inside, slower path 22 and is about ready to enter the switching station 12 the player will depress his bellows 114 or 116 causing the rail 62 to rise to its operative position causing the vehicle to be diverted to the outside, faster path 20. In similar manner, operation of either of the bellows 114 and 116 will cause the rail 60 that is normally in raised, operative position to be lowered so as to permit a vehicle that is already in the outside, faster path 20 to continue along the faster path 20. But the tactics have only begun. Bear in mind that it is possible for the opponent of the player who desires to actuate the rails 60 and 62 to block such effort by prematurely depressing his bellows 114 or 116, the result of which may be to preclude his opponent from timely operating his bellows to gain access to the outside, faster path 20.

The counting and recording station 16 is illustrated in FIGS. 6 – 7 wherein it will be apparent that the casing 120 is provided with legs 122 which rest on opposite sides of the trackway 12. The front panel is provided, as illustrated in FIG. 2 with indicia designating the number of laps that each vehicle has made at any particular point in time. Two larger gear wheels 126 are mounted within the casing 120 and provided with shafts 128 to which the pointers 130 are secured. Thus, as each of the gear wheels 126 rotates it will be apparent that the corresponding pointers 130 rotate designating the number of times that each vehicle has traversed the trackway 12. Each gear wheel 126 meshes with a smaller gear wheel 132 suitably journalled to the casing 120 for rotation. The smaller gear wheels 132 are formed as an integral part of somewhat larger gear wheels 134 provided with exaggerated teeth. The reference numeral 136 designates resilient prongs that are secured at one end to the casing 120 and which terminate at the opposite end in a toothlike terminal 138 that is designed to engage with the teeth of the gears 134 so as to stabilize the movement of the gears 134.

Appropriately journalled within the casing 120 is a shaft 140 to which is rigidly secured a first actuating member designated by the reference numeral 142 and which comprises a first depending arm 144 provided with laterally extending arm 146, a second arm 148 substantially of the same configuration as arm 144 but which is not provided with a corresponding laterally extending arm and members 150 that are connected to each other. It is apparent that the first actuating member 142 comprising the depending arms 144 and 148 and the connecting members 150 rotates in unison about the shaft 140. Also mounted to rotate in unison about the shaft 140 with the first actuating member 140 is a tripping arm 153 provided at the end thereof with a tooth like terminal 154 that meshes with the teeth of the gear wheel 134. In similar manner, there is provided a second actuating member 156 provided with depending arms 158 and 160, the arm 160 being provided with a laterally extending arm 162 corresponding to the arm 146. Similarly, a tripping arm 164 terminating in a tooth like terminal 165 is secured to the second actuating member 156 and mounted to rotate therewith about the shaft 140.

From FIG. 7 it will be apparent that the rear of the casing 120 is provided with an outwardly extending flexible arm 166 that normally engages and exerts pressure downwardly upon the arm 168 which is formed as a part of the first actuating member 142 whereas a similar arm 170 engages and exerts a downward pressure against the shoulder 172 formed as an integral part of the second actuating member 156. In this manner, the first and second actuating members 142 and 156 are normally urged in a clockwise direction about the shaft 140.

It will be apparent from FIG. 2 that one of the vehicles 18 is provided with an upstanding arm 174 while the other vehicle 18' is provided with upstanding arm 174'. Thus, as vehicle 18 passes through the counting section 16, the arm 174 contacts the depending arm 160 in path 20 or the depending arm 158 in path 22. In similar manner, as the other vehicle 18' passes through the counting section 16 the arm 174' contacts the depending arm 148 in path 20 or the depending arm 144 in path 22. Thus, car 18' causes movement of the first actuating member 142 while car 18 causes movement of the second actuating member 156, regardless of which of the paths 20 and 22 either of the cars 18 and 18' is in. The upward movement of the actuating members 142 and 156 is followed by abrupt downward movement thereof under the influence of the flexible arms 166 and 170 in turn causing the tooth like terminals 154 and 165 to mesh with and rotate the respective gears 134 in turn causing the teeth of the gears 132 to mesh with and rotate the gears 126 in turn causing the respective pointers 130 to rotate across the face of the respective front dials indicating the number of laps each vehicle has completed. The ability to account for the number of laps each vehicle has completed, regardless of which path the vehicle is in, is thus assured.

Figures 8, 10:
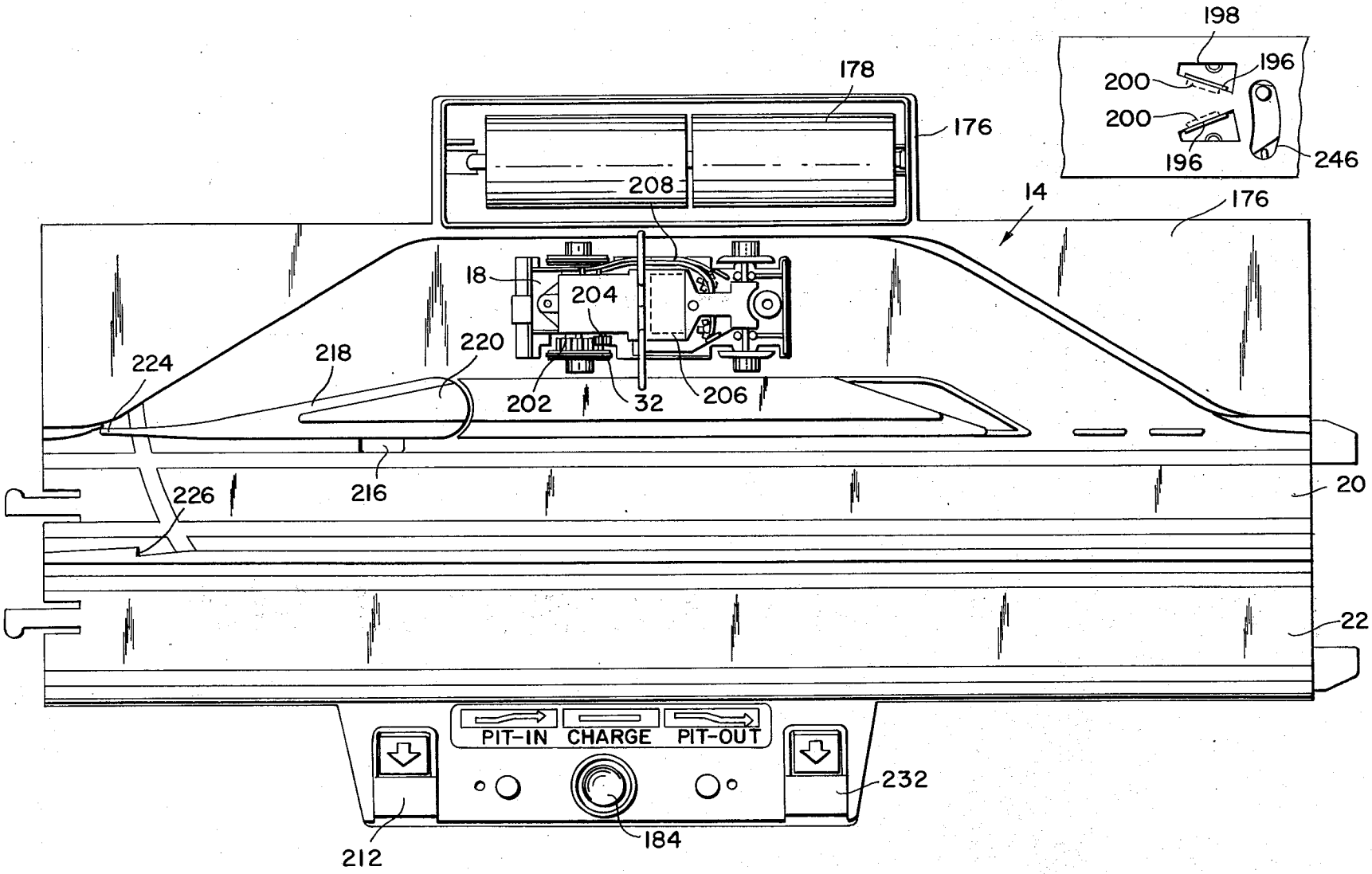
FIG. 8 is a plan view of one of the energizing stations with a vehicle in position to be recharged, illustrating in particular the configuration of the rail sections for directing the vehicle to and from the recharging station.
FIG. 10 is a top plan view of a portion of one of the energizing stations, illustrating in particular the relationship between the electrical contacts of the vehicle and the station.
Figure 9:
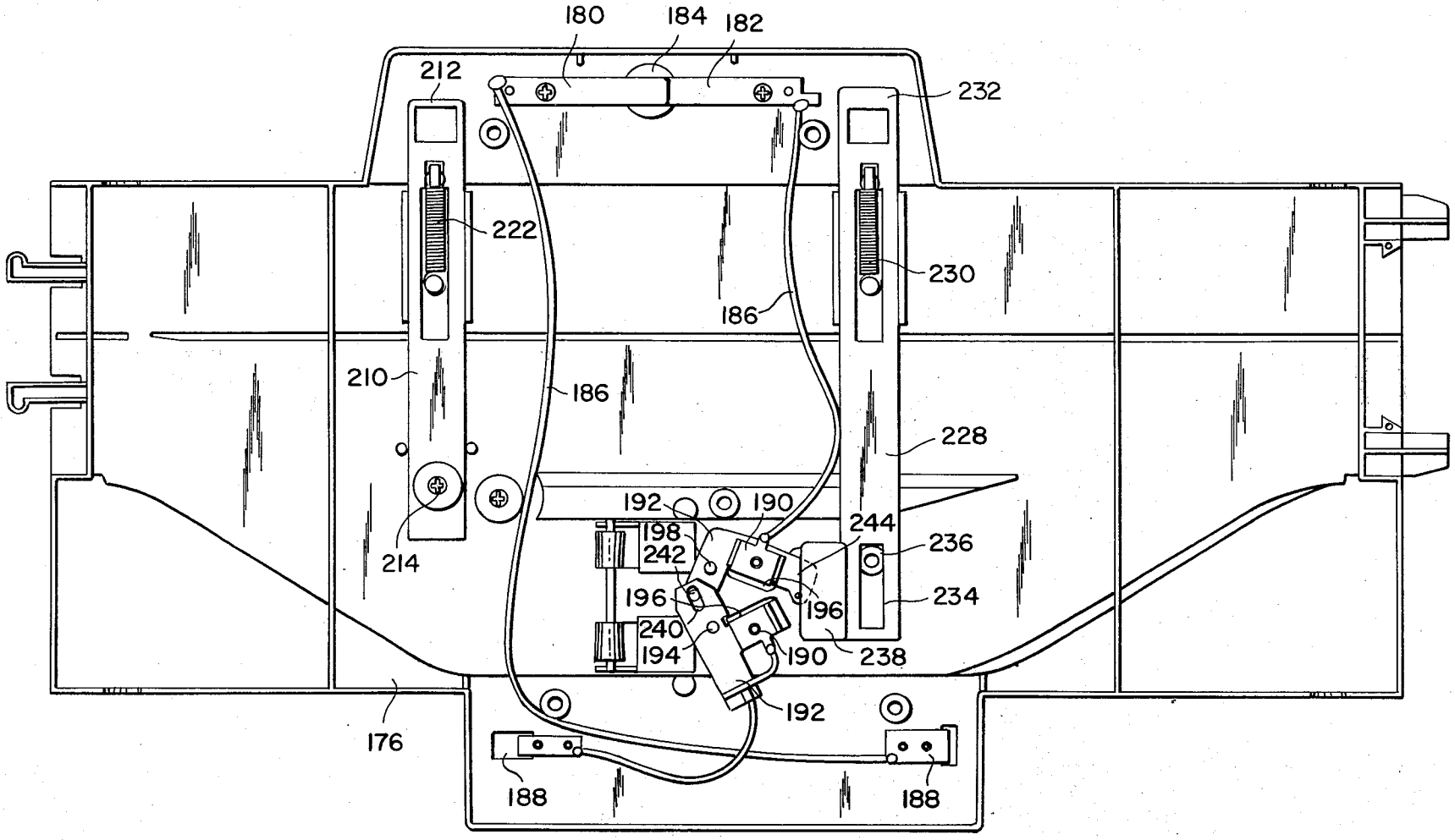
FIG. 9 is a bottom view of one of the energizing stations with a panel removed illustrating in particular the mechanisms for changing the position of the rail sections and the circuitry for connecting the batteries to the rechargeable storage cell that powers the electric motor of the vehicle.

The construction of each of the recharging stations 14 is illustrated in FIGS. 8 – 9. Each of the stations 14 is provided with a casing 176 provided at the top thereof with a compartment 176 within which the recharging batteries 178 are located. Within the other side of the casing 176 there are mounted two flexible electrical contacts 180 and 182 normally spaced apart from each other. Above the contacts 180 and 182 there is mounted for reciprocating movement a control button 184. Appropriate wiring 186 connects the battery housing terminals 188, the switching mechanism as previously described, and the contacts 190 that are mounted to the insulated members 192 which are mounted for action about posts 194. The contacts 190 are provided with upstanding arms 196 that extend upwardly through openings 198 provided in the top wall of the casing 176, as illustrated in FIG. 10. Each of the vehicles 19, in turn, is provided with electrical contacts 200 extending downwardly therefrom in the vicinity of the guiding member 118, as illustrated in FIG. 2.

Each of the vehicles 18 is provided with a miniature electric motor of conventional design designated generally by the reference numeral 202 in FIG. 8 which is designed to drive the rear wheels 32 through a conventional gearing arrangement generally designated by the reference numeral 204. Provided forwardly within each vehicle 18 is a rechargeable storage cell also of conventional design and designated generally by the reference numeral 206. Appropriate wiring designated generally by the reference numeral 208 connects the electrical contacts 200 with the rechargeable storage cell 206 and the motor 202.

Mounted for reciprocating movement within the casing 176 is a first operating member 210 having a handle 212 protruding upwardly through the casing 176 as illustrated in FIG. 8. The operating member 210 is provided with a shaft 214 that extends upwardly through an opening 216 in the casing 176 and which is connected to the track section 218, that is appropriately mounted for rotation with respect to the casing 176 about axis 220. Thus, as the fingerpiece 212 is retracted the operating member 210 is moved downwardly causing the rail section 218 to rotate in a counterclockwise direction, as illustrated in FIG. 8, until the end 224 thereof engages the notch 226 at which time it will be apparent that the vehicle 18 is diverted from the path 20 into the recharging area. As the button 184 is depressed, the elecrtrical contacts 180 and 182 are forced into engagement with each other completing the circuit at which time the batteries 178 charge the storage cell 206 within the vehicle 18.

Returning to FIG. 9, it will also be apparent that there is provided a second operating member 228 reciprocably mounted within the casing 176 and normally urged to a forward position by the spring 230. The operating member 228 also terminates in a fingerpiece 232 which protrudes upwardly through the casing 176. The operating member 228 is provided with an opening 234 within which the post 236, formed as an integral part of the casing 176, protrudes. The operating member 228 is further provided with a cavity within the right-hand section 238 thereof, as illustrated in FIG. 9, within which a portion of one of the arms 192 is positioned. It will also be apparent that one of the arms 192 is provided with an opening 240 while the other arm thereof is provided with a post passing through the opening thus insuring that the arms 192 rotate in unison with each other. Finally, there is provided an upstanding post 244 on one of the arms 192 which extends upwardly through an opening 246 in the top of the casing 176, as illustrated in FIG. 10. Thus, after the vehicle 19 has been recharged the player operates the fingerpiece 232 causing the operating member 228 to move downwardly against the force of the spring 230 in turn causing the arms 192 to rotate about their axes 194 at which time the electrical contacts 196 separate from each other and the post 244 moves to the side. The removal of the post 246 from blocking relationship with respect to the guiding member 118 thus frees the vehicle 18 to move outwardly from the recharging area to re-enter the path 20 to continue the race.

I claim:

1. A racing game, comprising a continuous trackway provided with upstanding walls defining substantially separate first and second paths, vehicles provided with powered wheels that directly engage said first path and hubs that directly engage the tops of adjacent of said upstanding walls of said second path at which time said wheels are located above said second path, and a switching station within said trackway comprising means normally diverting said vehicles from said first path to said second path when passing through said station, means permitting said vehicles to remain in said first path when passing through said station, means normally retaining said vehicles in said second path as they pass through said station, and means permitting said vehicles to be diverted from said second path to said first path when they pass through said station.

2. A racing game as in claim 1, wherein said means normally diverting said vehicles from said first path to said second path and said means permitting said vehicles to remain in said first path comprise a first rail, a second rail mounted to move between a raised operative position and a lowered inoperative position, said first and second rails being oriented from said first path to said second path, and a guiding rod depending from each of said vehicles such that when said second rail is in its inoperative position said vehicle continues along said first path whereas when said second rail is in its raised, operative position said vehicle is directed from said first path to said second path, and means operatively connected to said second rail for moving same between said operative and inoperative positions, and means normally maintaining said second rail is in its operative position.

3. A racing game as in claim 2, wherein said means normally retaining said vehicles in said second path and permitting said vehicles to be diverted from said second path to said first path comprise a third rail, a fourth rail mounted to move between a raised operative position and a lowered inoperative position, said third and fourth rails being oriented to direct said vehicles from said second path to said first path, and means operatively connected to said fourth rail for moving same between said operative and inoperative positions, and means normally maintaining said fourth rail in its inoperative position.

4. A racing game comprising powered vehicles, a continuous trackway, means defining substantially separate paths within said trackway, means permitting said vehicles to achieve a greater velocity in one of said paths than in the other of said paths comprising wheels mounted for rotation with respect to said vehicle, said wheels being provided with hubs projecting outwardly therefrom, said hubs being of smaller diameter than said wheels, and wherein said separate paths of said trackway comprise a first path consisting of a flat surface against which said wheels of said vehicles engage such that when said vehicles are in said first path the rotation of said wheels on said flat surface drives said vehicles along said first path, and a second path provided with a flat surface and upstanding walls spaced apart from each other, said hubs engaging the tops of said walls, said walls extending upwardly from said flat surface of said second path a distance sufficient to prevent said wheels from engaging said flat surface of said second path, and switching means permitting the players to divert said vehicles from one of said paths to the other of said paths.

5. A racing game, comprising powered vehicles, each of said powered vehicles comprising a miniature electric motor operatively driving rear wheels and a rechargeable electrical energy source operatively connected to said motor, a continuous trackway, means permitting the players to recharge said energy source of each of said powered vehicles, comprising a recharging station provided with a source of electrical energy, first electrical contacts normally positioned to define a V-configuration and mounted to move apart from each other, circuit means electrically connecting said source of electrical energy and said first electrical contacts, and wherein said vehicles each include second electrical contracts complimentary in configuration with respect to said first electrical contacts, circuit means electrically connecting said electrical contacts and said rechargeable electrical energy source in said vehicles, means for diverting said vehicles from said trackway to said recharging station wherein said second contacts of said vehicles abut the inner surfaces of said first electrical contacts, and means moving said first electrical contacts apart permitting said vehicles to re-enter said trackway.

6. A racing game, comprising vehicles, a continuous trackway comprising inner and outer substantially separate paths along which the vehicles race, means permitting the vehicles to travel faster in the outside path than in the inside path, switching means normally diverting the vehicles from the faster, outer path to the slower, inner path and retaining the vehicles in the slower, inner path, and control means operative to actuate the switching means to divert the vehicles from the slower, inner path to the faster, outer path and to retain the vehicles in the faster, outer path.

7. A racing game as in claim 6, including counting means associated with said trackway for independently counting and recording for observation by the players the number of times the vehicles traverse the trackway regardless of whether the vehicles move along the inner or outer paths.

8. A racing game as in claim 7, wherein each of said vehicles comprises a miniature electric motor operatively driving rear wheels and a re-chargeable electrical energy source operatively connected to said motor, and wherein said game further comprises means permitting the players to recharge said energy source when desired.

9. A racing game as in claim 8, wherein said counting means comprises a station positioned in close proximity to said trackway and provided with sets of indicia representative of the number of times a vehicle has passed said station, indicator means corresponding to each set of indicia actuating means associated with each set of indicia and operatively connected to the corresponding of said indicator means to move same, said actuating means inclusing arms that move in unison, and wherein said vehicles each include an upstanding abutment arranged to engage only the arms of that one of said actuating means corresponding thereto.

10. A racing game, comprising a plurality of vehicles each comprising wheels provided with hubs projecting outwardly therefrom, said hubs being of smaller diameter than said wheels, a continuous trackway comprising a first path having a flat surface against which said wheels of said vehicles engage such that when said vehicles are in said first path the rotation of said wheels on said flat surface drives said vehicles along said first path, and a second path provided with a flat surface and upstanding walls spaced apart from each other, said hubs engaging the tops of said walls, said walls extending upwardly from said flat surface of said second path a distance sufficient to prevent said wheels from engaging said flat surface of said second path, and switching means permitting the players to divert said vehicles from one of said paths to the other of said paths.

11. A racing game as in claim 10, wherein said switching means comprises rail means normally diverting said vehicles from said first path to said second path while retaining said vehicles in said second path, and control means operable by each of the players to actuate said rail means to divert said vehicles from said second path to said first path and to retain said vehicles in said first path.

12. A racing game as in claim 11, wherein said control means comprises separate bellows for each of the players, and means operatively connecting said bellows to said rail means.

* * * * *